US007322371B2

(12) United States Patent
You

(10) Patent No.: US 7,322,371 B2
(45) Date of Patent: Jan. 29, 2008

(54) LOCK MECHANISM OF LARGE UMBRELLA FOR EFFECTING A MULTI-SECTIONAL LENGTH ADJUSTMENT OF TELESCOPIC SHANK

(76) Inventor: Ching-Chuan You, Rm. 532, 5Fl. No. 144, Ming Chuan E. Rd., Sec. 3, P.O. Box 1-79, Taipei (TW) 105

( * ) Notice: Subject to any disclaimer, the term of this patent is extended or adjusted under 35 U.S.C. 154(b) by 268 days.

(21) Appl. No.: 11/246,099

(22) Filed: Oct. 11, 2005

(65) Prior Publication Data

US 2007/0079854 A1 Apr. 12, 2007

(51) Int. Cl.
*A45B 19/04* (2006.01)
*A45B 19/08* (2006.01)
*A45B 25/06* (2006.01)

(52) U.S. Cl. ..... 135/25.4; 135/25.1; 135/20.3; 135/28; 135/37

(58) Field of Classification Search ..... 135/20.3, 135/25.1, 25.4, 25.41, 28, 22, 24, 37–41
See application file for complete search history.

(56) References Cited

U.S. PATENT DOCUMENTS 5,349,976 A * 9/1994 Ko ..... 135/25.4
5,357,994 A * 10/1994 Chung ..... 135/22
6,684,893 B2 2/2004 Kuo
6,810,890 B2 * 11/2004 Lin et al. ..... 135/16
2003/0062074 A1 * 4/2003 Kuo ..... 135/24
2003/0089387 A1 * 5/2003 Chen ..... 135/24

* cited by examiner

*Primary Examiner*—David Dunn
*Assistant Examiner*—Danielle Jackson

(57) ABSTRACT

A lock mechanism mounted in a large umbrella includes a sliding sleeve including an aperture on surface of a lower extension, a telescopic shank including a lower tube fixed in a handle and a sliding upper tube, a lock device disposed in the upper tube such that disposing a resilient projection of the lock device through holes of the tubes may fasten the shank, an actuation assembly for receiving the extension and including a transverse opening and a spring biased actuation member having a portion disposed in the aperture for locking the extension in a closed position of the umbrella, the actuation member including a trigger, and a spring biased rib fixing assembly disposed between the handle and the actuation assembly. Pushing the trigger will disengage the portion with the aperture to open the umbrella. Operating the lock device will effect a subsequent multi-sectional length adjustment of the shank.

9 Claims, 13 Drawing Sheets

LOCK MECHANISM OF LARGE UMBRELLA FOR EFFECTING A MULTI-SECTIONAL LENGTH ADJUSTMENT OF TELESCOPIC SHANK

BACKGROUND OF THE INVENTION

1. Field of Invention

The present invention relates to lock mechanisms of umbrella and more particularly to such a lock mechanism mounted in a large umbrella (e.g., beach umbrella, golf umbrella, or the like) capable of quickly effecting a multi-sectional length adjustment of a telescopic shank in response to strong wind.

2. Description of Related Art

A conventional large umbrella (e.g., beach umbrella, golf umbrella, or the like) 1 is shown in FIGS. 1 and 2. The umbrella 1 comprises a shank 11, a plurality of spreaders 12, a lower sliding sleeve 13, an elongate actuation member 14, a handle 15, and a hub (not shown) at a top of the shank 11. A plurality of link bars are interconnected the spreaders 12 and the sleeve 13. The actuation member 14 comprises an upper flexible element 16 having a curved portion urged against an inner wall of the shank 11, a lower tab 17 disposed in a lower aperture 19 of the sleeve 13 in a locked state of the umbrella, and a bottom push button 18 adapted to push to cause the tab 17 to clear the aperture 19 for unlocking the umbrella. That is, a simple pressing of the push button 18 can automatically open the umbrella.

However, the flexible element 16 may suffer fatigue after a predetermined period time of use. And in turn, it may compromise the desired lock mechanism of the umbrella. Still however, the shank 11 is an elongate member and is not telescopic. Thus, a person, particularly a short person, may encounter great difficulties of operating the umbrella by holding the shank 11 when wind is heavy. Yet however, a telescopic shank 11 still cannot solve the problem since the engagement of a tab 17 and an aperture 19 of a sleeve 13 is relatively weak for a large umbrella (i.e., not reliable in use). A large curved member projected from an outer surface of a shank may solve the problem. However, its bulky size may adversely affect a normal operation of the umbrella.

U.S. Pat. No. 6,684,893 discloses a simplified controlling apparatus of an automatic umbrella. The '893 patent describes a spring-biased control loop and a projecting button. A first pressing of the button is adapted to move the control loop inward for opening the umbrella. A further pressing of the button will push a bullet-head to disengage with a shaft, thereby enabling a closing of the umbrella. However, the '893 patent is typically relatively complex in constructions, costly to manufacture, trouble-prone, unreliable in use, and cannot be mass produced easily.

Moreover, ribs cannot dispose in parallel relationship with the shank in a closed state of typical umbrella due to structure factor. Thus, rib tips may entangle with other objects when the umbrella and the objects are placed together. Hence, a need has arisen for an improved lock mechanism of a large umbrella capable of effecting a multi-sectional length adjustment of its telescopic shank.

SUMMARY OF THE INVENTION

It is therefore an object of the present invention to provide a lock mechanism mounted in a large umbrella having a handle, a plurality of ribs, a plurality of spreaders, and a canopy, the lock mechanism comprising a sliding sleeve connected to the spreaders and including a lower extension and a first aperture on a surface of the extension; a telescopic shank including a lower tube fixed in the handle, a sliding upper tube adapted to slide in the lower tube, and a lock device disposed in the upper tube; an actuation assembly including a hollow upper enlargement with the extension received therein, a transverse first opening formed on the enlargement, and a spring biased actuation member adapted to have a first predetermined portion disposed in the first aperture for locking the extension in a closed position of the umbrella, and a second predetermined portion disposed externally of the enlargement; and a spring biased rib fixing assembly disposed between the handle and the actuation assembly, the rib fixing assembly being adapted to fix tips of the ribs in the closed position of the umbrella; whereby pushing the second predetermined portion will disengage the first predetermined portion with the first aperture to unlock the extension for sliding the sleeve upward to open the umbrella, and operating the lock device will effect a subsequent multi-sectional length adjustment of the shank. By utilizing the present invention, it is possible of quickly effecting a multi-sectional length adjustment of the shank in response to strong wind.

In a first aspect of the present invention, the upper tube comprises a lengthwise groove and a lower second aperture, and the lower tube comprises two longitudinal recesses in communication with each other and disposed in the groove so as to guide a sliding of the upper tube in the lower tube.

In a second aspect of the present invention, the lower tube comprises a plurality of longitudinal holes formed a surface, and the lock device comprises an arcuate elastic member urged against an inner surface of the upper tube, the elastic member including a protrusion formed at one end projected from the second aperture through one of the holes.

In a third another aspect of the present invention, the protrusion is adapted to push to compress the elastic member until the protrusion clears the second aperture, the upper tube is adapted to subsequently push downward until the protrusion aligns with a different one of the holes, and the protrusion is adapted to subsequently project from the different one of the holes.

In a fourth aspect of the present invention, the enlargement further comprises a receptacle opposite the first opening for anchoring the actuation member, and a lower projecting portion including a plurality of flanges formed therearound; the second predetermined portion of the actuation member is formed as a trigger; and the actuation member further comprises a loop interconnected the first and the second predetermined portions, a cavity formed in the first predetermined portion opposite the receptacle, and a first elastic element having one end anchored in the receptacle and the other end anchored in the cavity.

In a fifth aspect of the present invention, the rib fixing assembly comprises a cup including a bottom second opening urged against one of the flanges, and a second elastic element compressed between the cup and the handle in which the tips of the ribs are adapted to dispose proximate the cup in response to closing the umbrella.

The above and other objects, features and advantages of the present invention will become apparent from the following detailed description taken with the accompanying drawings.

DETAILED DESCRIPTION OF THE INVENTION

Figure 1:
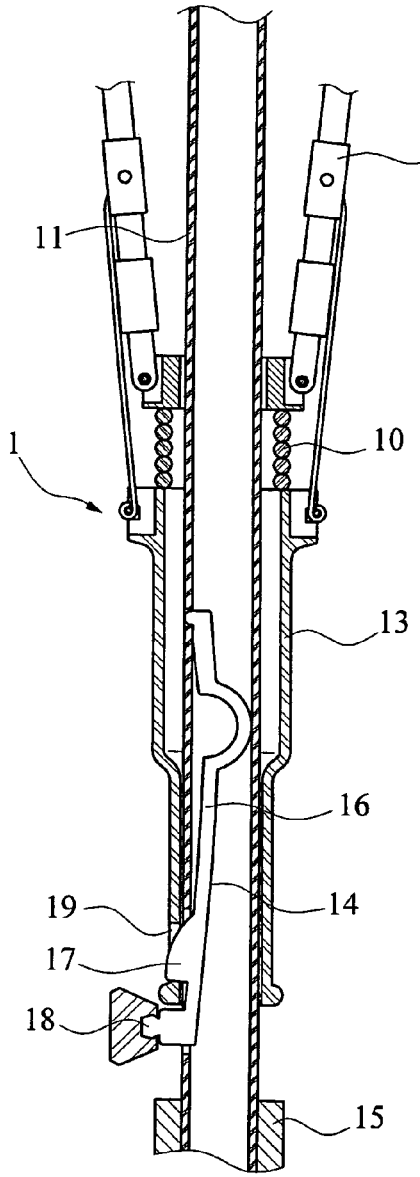
FIG. 1 (PRIOR ART)
FIG. 1 is a sectional view of a portion of large umbrella incorporating a conventional lock mechanism in its locked state.
Figure 2:
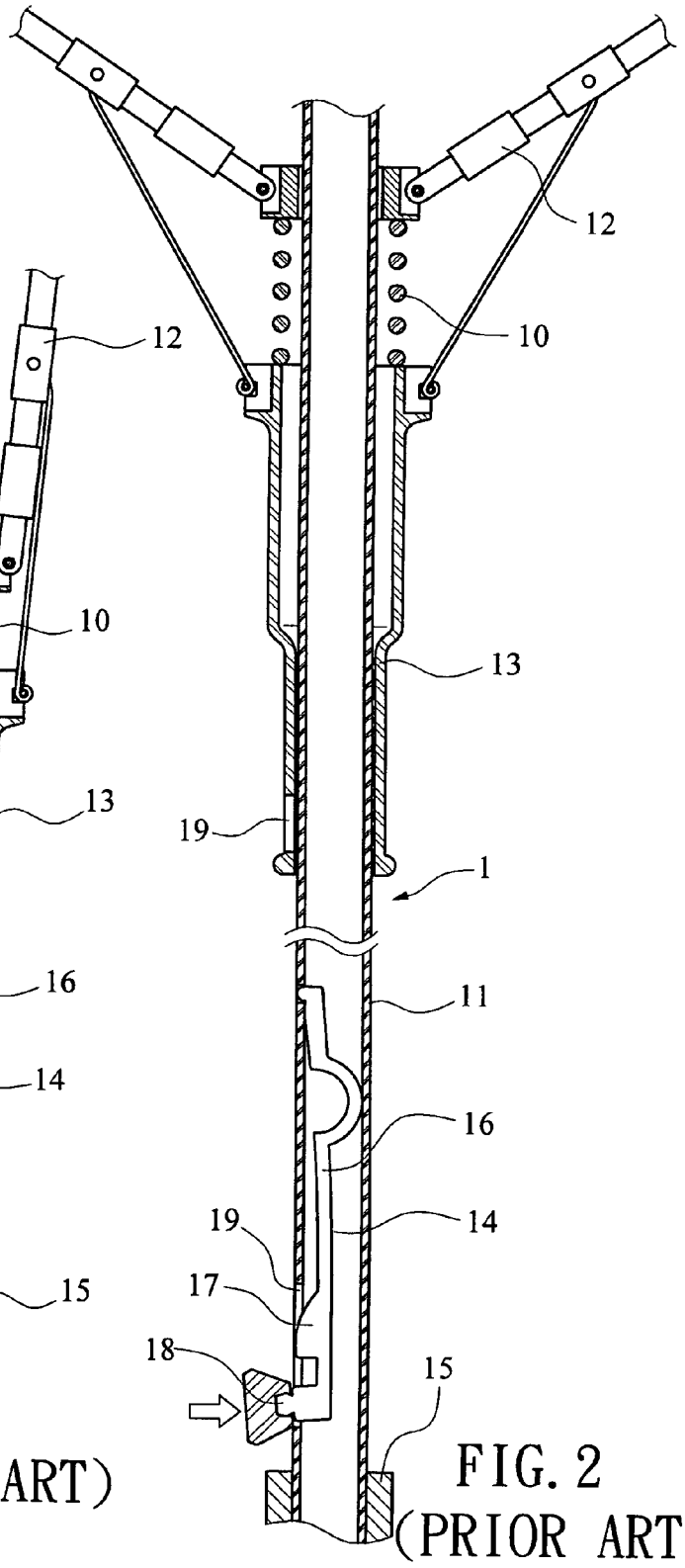
FIG. 2 (PRIOR ART)
FIG. 2 is a view similar to FIG. 1 where the umbrella is open after pushing a push button.
Figure 3:
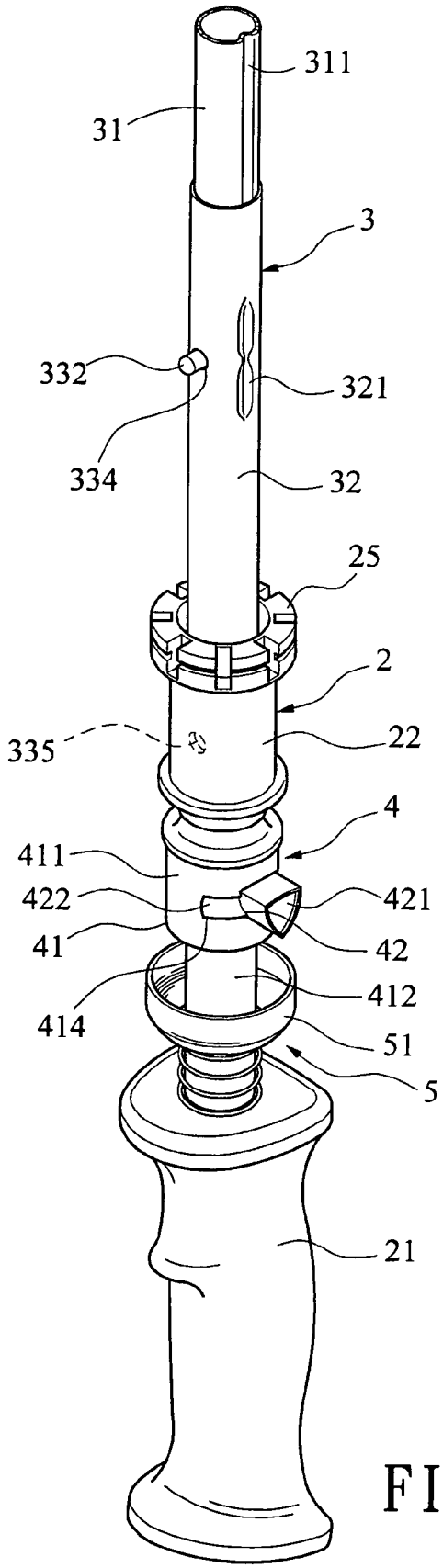
FIG. 3 is a perspective view of a preferred embodiment of lock mechanism mounted in a large umbrella according to the invention.

Referring to FIGS. 3 to 14, a lock mechanism in accordance with a preferred embodiment of the invention mounted in a large umbrella is shown. The lock mechanism comprises a frame assembly 2, an actuation assembly 4, and a rib fixing assembly 5. Each component is discussed in detailed below. The frame assembly 2 comprises a shank assembly 3, a handle 21, a sliding sleeve 22, a plurality of ribs 23, and a canopy 24 (see FIG. 13). The sleeve 22 is provided with a top ring 25 with a plurality of cavities formed therearound for receiving the ribs 23 in a closed position of the umbrella, a lower extension 26, an aperture 27 on a surface of the extension 26, and a projecting member 28 above the aperture 27 on the extension 26.

The shank assembly 3 comprises a sliding upper tube 31, a fixed lower tube 32, and a lock device 33. The upper tube 31 comprises a lengthwise groove 311 having a lower stop 3110 and a lower aperture 312. The upper tube 31 is adapted to partially slide into the lower tube 32 (i.e., the shank assembly 3 being telescopic). The lower tube 32 comprises two longitudinal recesses 321 in communication with each other and disposed in the groove 311 such that a sliding of the upper tube 31 in the lower tube 32 can be guided and a relative positioning therebetween can be carried out.

Figure 4:
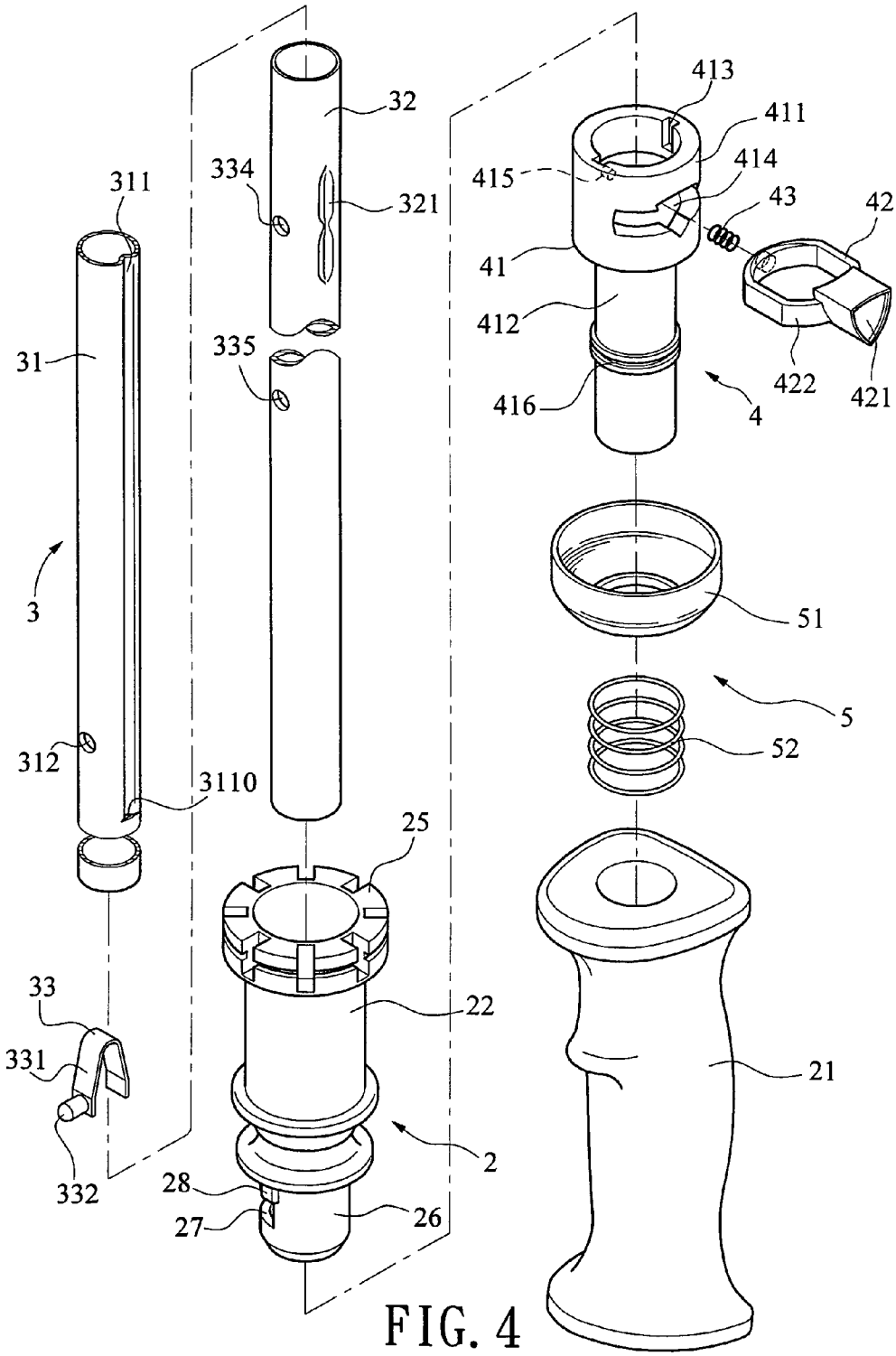
FIG. 4 is an exploded perspective view of FIG. 3.
Figure 5A:
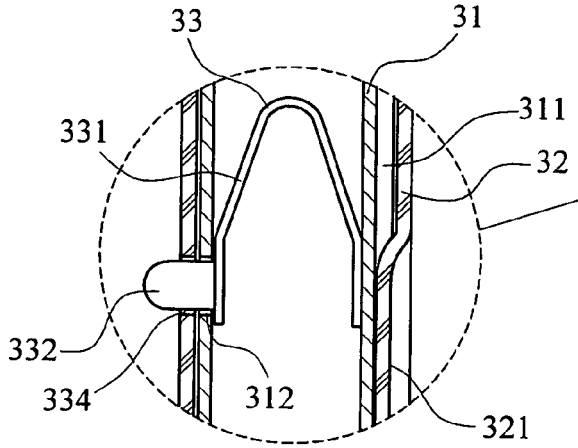
FIG. 5A is a detailed view of the area in an upper circle in FIG. 5.
Figure 5B:
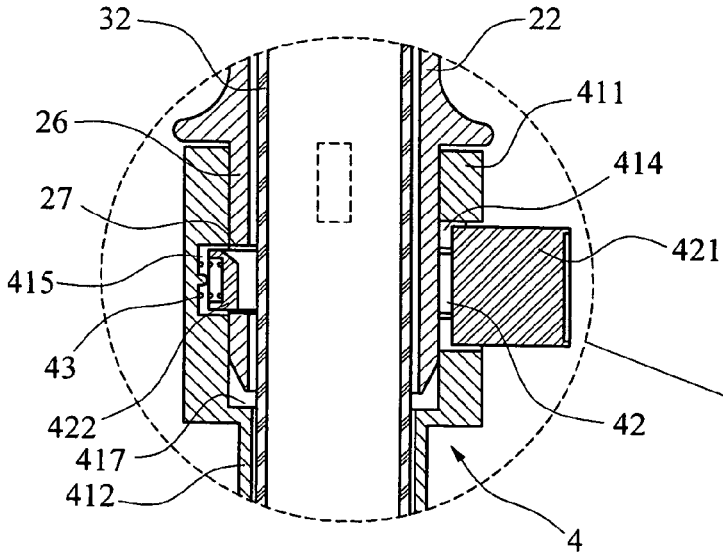
FIG. 5B is a detailed view of the area in a lower circle in FIG. 5.
Figure 5:
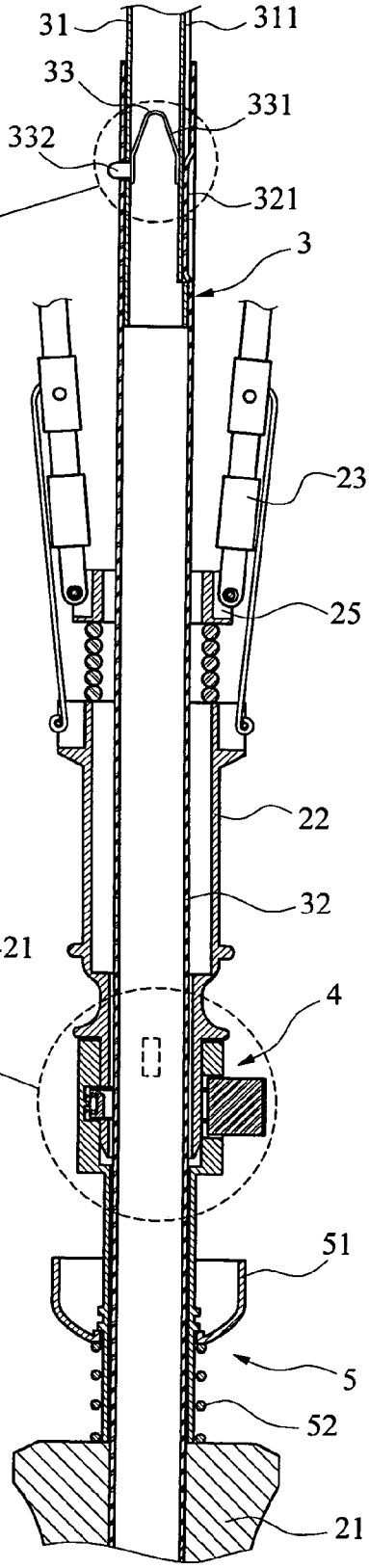
FIG. 5 is a longitudinal sectional view of FIG. 3 where the umbrella is closed.

As shown in FIGS. 4, 5, and 5A, the lock device 33 comprises an inverted V-shaped elastic member 331 urged against an inner surface of the upper tube 31, and a protrusion 332 formed at one end of the elastic member 331 and projected from the aperture 312. The protrusion 332 has a predetermined length for permitting the sleeve 26 to pass therethrough without being interfered by sliding in opening or closing the umbrella. The lock device 33 is further provided with an upper first aperture 334 and a lower second aperture 335 both formed on the lower tube 32. The protrusion 332 is adapted to further project from one of the first and second apertures 334 and 335 when the upper tube 31 slides in the lower tube 32 in a length adjustment operation of the upper tube 31 (i.e., the shank).

The actuation assembly 4 comprises a hollow cylinder 41, an actuation member 42, and a spring 43. The cylinder 41 is provided at a lower end of the shank assembly 3 and is projected from the handle 21. The cylinder 41 comprises an upper enlargement 411 including two opposite notches 413 on an inner surface engaged with the projecting member 28, a transverse opening 414, and a receptacle 415 (see FIG. 5B) opposite the opening 414; and a lower portion 412 including a plurality of annular flanges 416 provided in parallel on the outer surface of the lower portion 412. The actuation member 42 comprises a trigger 421 and a loop 422.

In assembly, insert the actuation member 42 into the enlargement 411 through the opening 414 with the spring 43 being compressed between the receptacle 415 and a recess of the loop 422 opposite the trigger 421 and the trigger 421 being disposed externally of the enlargement 411. Next, insert the lower extension 26 into the enlargement 411 until being stopped by an internal shoulder 417 between the enlargement 411 and the lower portion 412 in which a portion of the loop 422 opposite the trigger 421 is further pushed to dispose in the aperture 27 (i.e., locked) by the expanding spring 43. As a result, the actuation member 42, the spring 43, and the extension 26 are held captive. This is the closed state of the umbrella (see FIGS. 5 and 5B).

The rib fixing assembly 5 comprises an upper cup 51 having a bottom opening with the lower tube 32 snugly inserted therethrough and further into the handle 21 to fasten therein by molding, and a spring 52 compressed between the handle 21 and an underside of the cup 51 to fasten the cup 51 at one of the flanges 416.

Figure 6A:
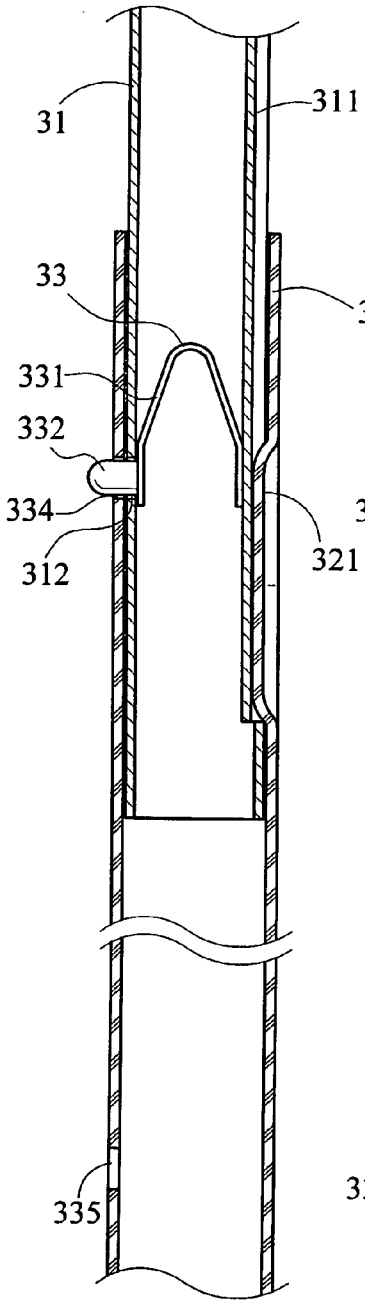
FIGS. 6A, 6B, and 6C are longitudinal sectional views of the lock device for illustrating steps of unlocking and locking again in a length adjustment operation of shank.
Figure 6B:
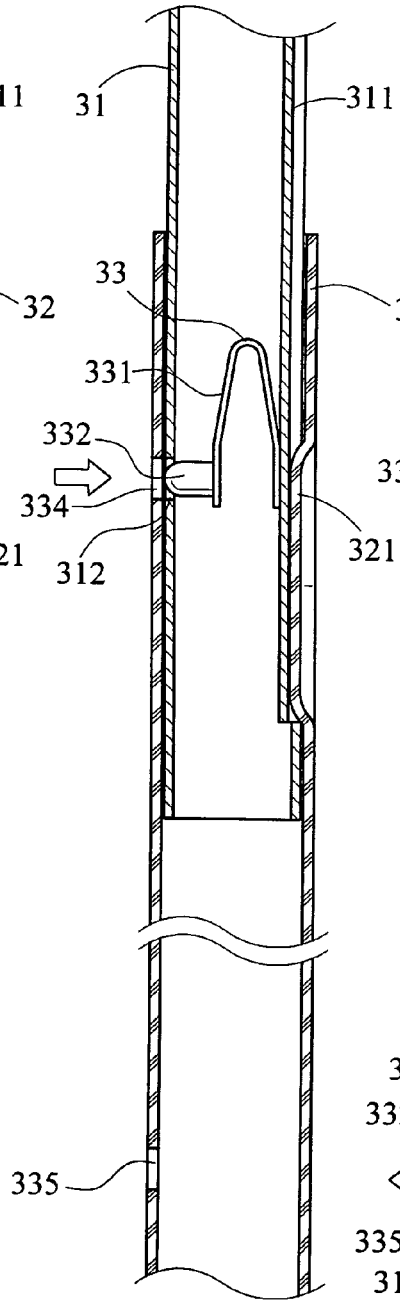
Figure 6C:
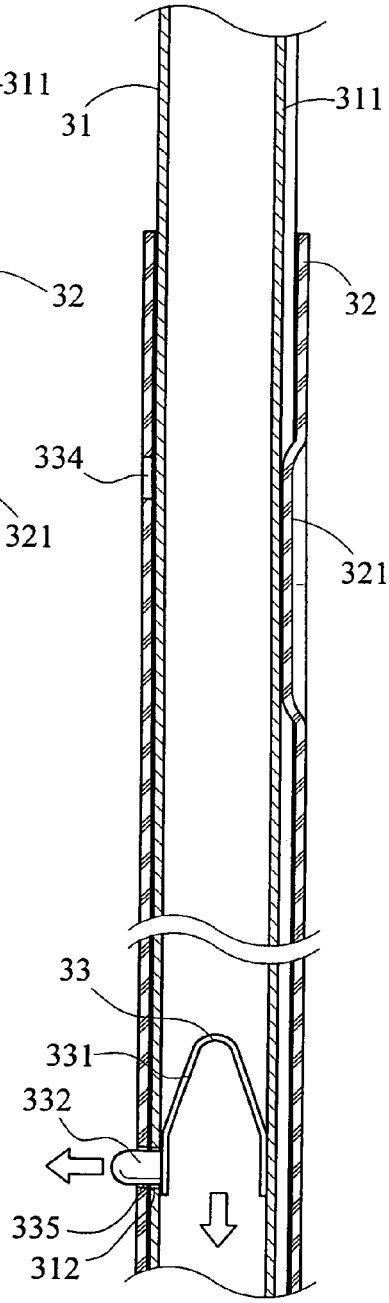
Figure 7:
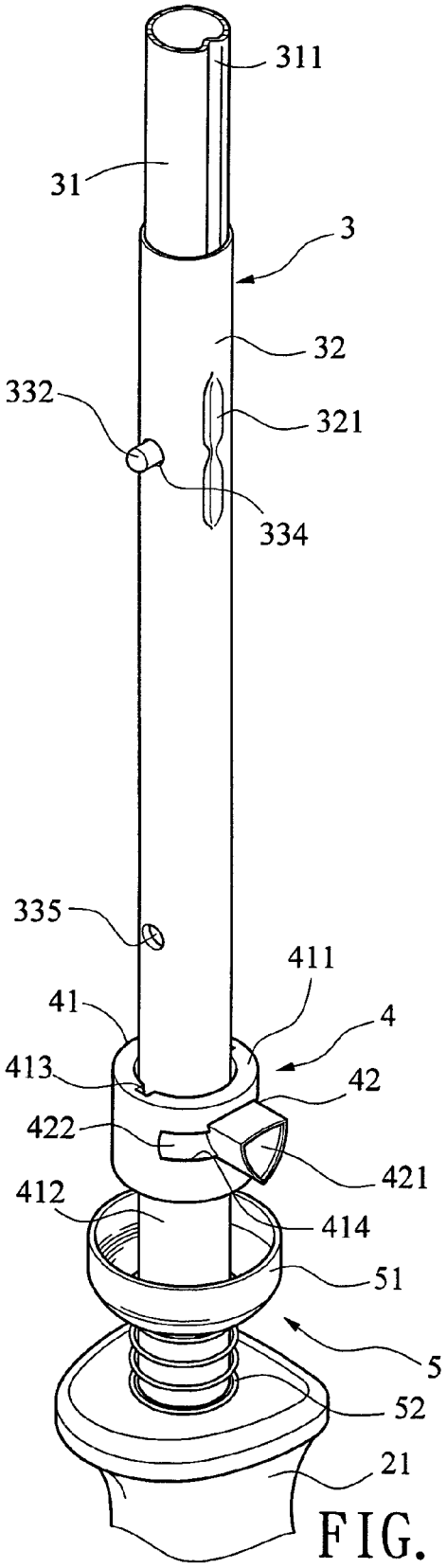
FIGS. 7 and 8 are perspective views of the lock mechanism for illustrating length of the shank before and after adjustment respectively.
Figure 8:
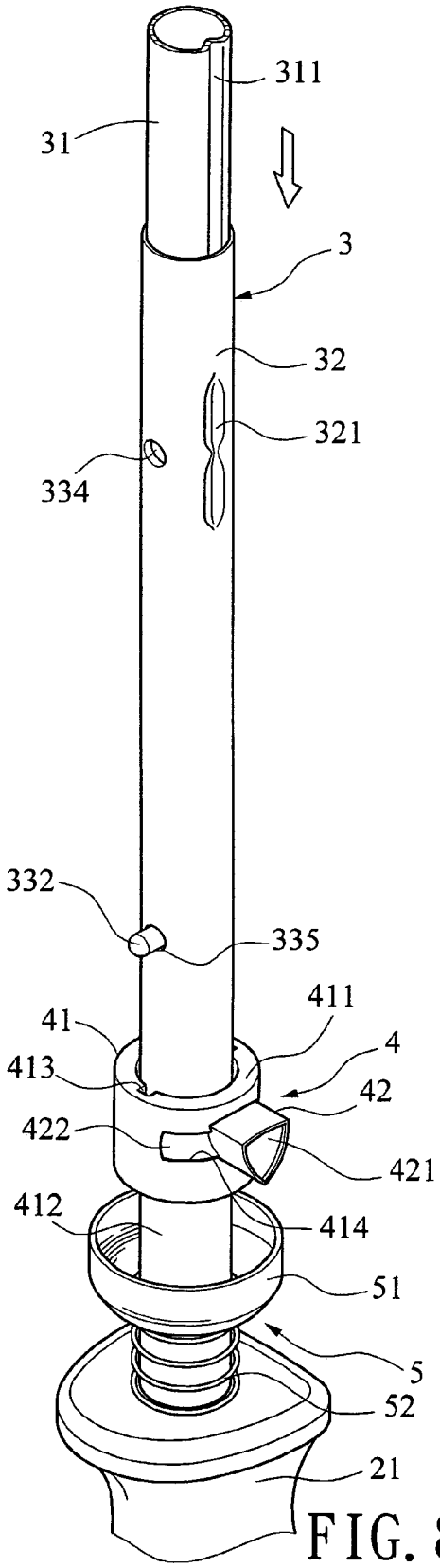
Figure 9A:
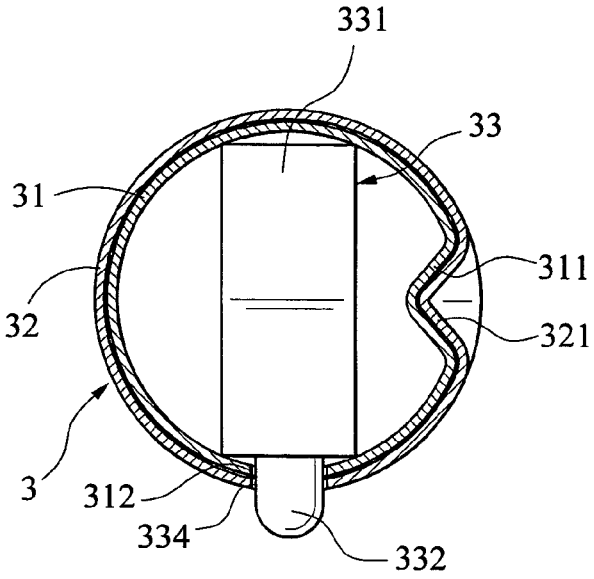
FIGS. 9A and 9B are transverse sectional views for illustrating the lock device in its locked and unlocked positions respectively.
Figure 9B:
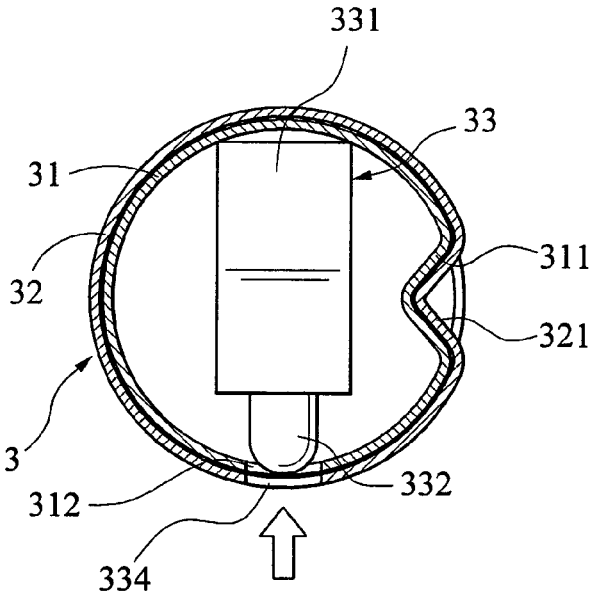

Referring to FIGS. 6A to 9B specifically, a shank length adjustment operation will be described in detail below. As shown in FIGS. 6A, 7 and 9A, the protrusion 332 projects from the first aperture 334 in a normal position of the umbrella. First, push the protrusion 332 inward to compress the elastic member 331 until the protrusion 332 clears the first aperture 334 with a head of the protrusion 332 disposed in the aperture 312 (see FIG. 6B). Next, push the upper tube 31 downward until the protrusion 332 aligns with the second aperture 335 (see FIGS. 6C, 8 and 9B). At this time, the protrusion 332 automatically projects from the second aperture 335 due to the expansion of the energized elastic member 331. It is seen that a distance between the first aperture 334 and the second aperture 335 is the length that the shank of the umbrella is able to decrease.

Figure 10:
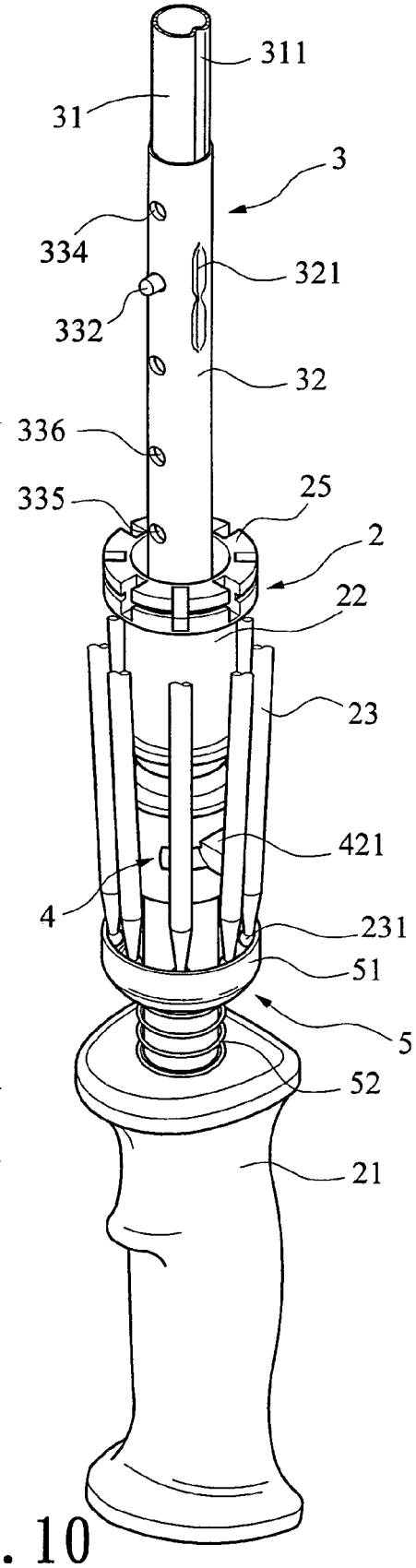
FIG. 10 is a perspective view of the lock mechanism incorporating another embodiment of the lock device where rib tips are fixed by a rib fixing assembly.

Referring to FIG. 10, another embodiment of the lock device is shown. Another embodiment is identical to the above embodiment, except that a plurality of equally spaced apertures 334, 335, and 336 are formed longitudinally on the lower tube 32. Thus, the protrusion 332 is adapted to project from one of the apertures 334, 335, and 336 in a shank length adjustment operation. This also effects a multi-sectional length adjustment of the shank assembly 3.

Figures 11, 11A:
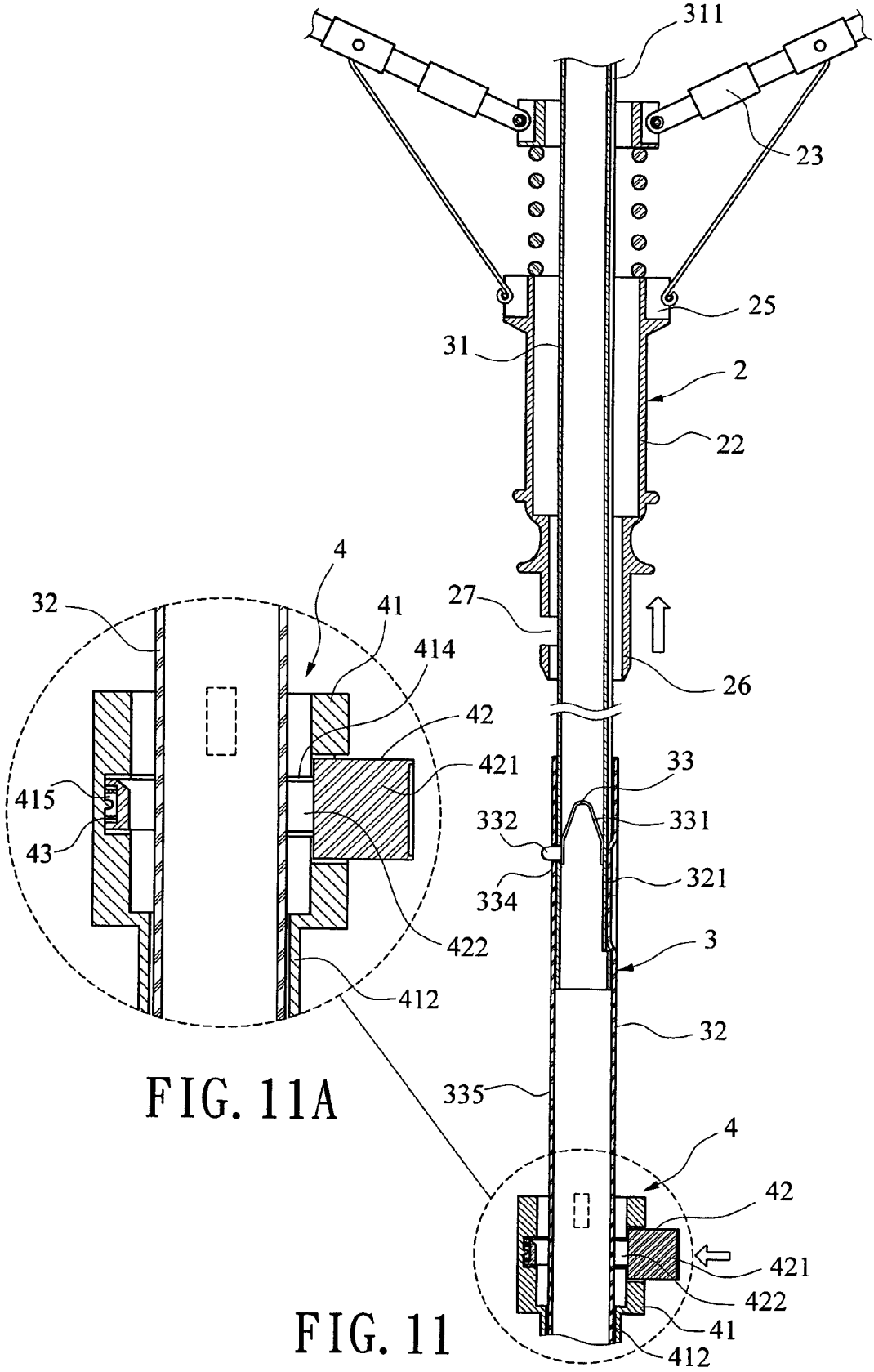
FIG. 11 is a view similar to FIG. 5 where the umbrella is being opened.
FIG. 11A is a detailed view of the area in a circle in FIG. 11.

Referring to FIGS. 11 and 11A, for opening the umbrella a user may simply push the trigger 421 to move the loop 42 inward to clear the aperture 27. Thus, the extension 26 (i.e., the sleeve 22) is free to slide upward to pass a joining portion of the upper tube 31 and the lower tube 32 without being interfered. At the same time, the spring 43 is compressed. A releasing of the trigger 421 will thus expand the spring 43 to move the actuation member 42 back to its inoperative position.

Figure 12:
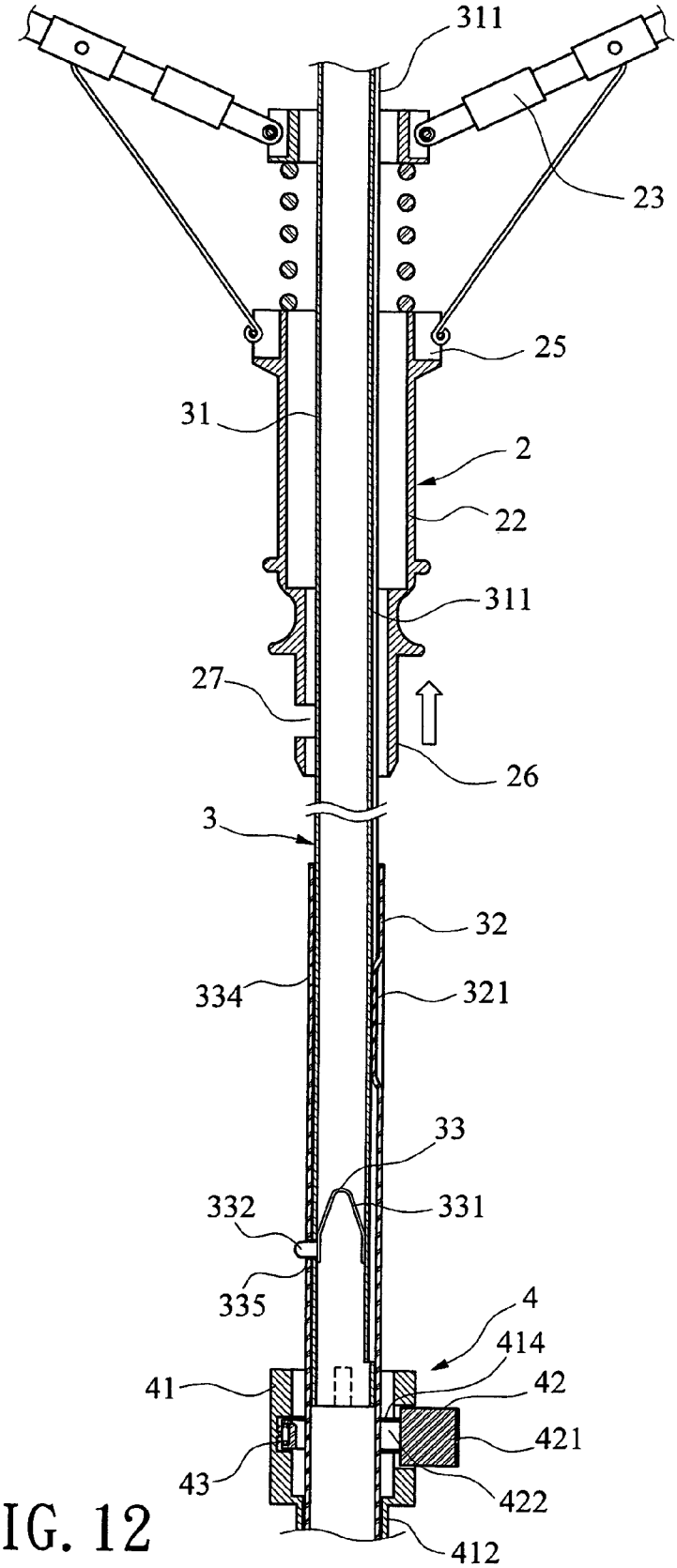
FIG. 12 is a view similar to FIG. 11 for illustrating length reduction of the shank in a length adjustment operation.

Referring to FIG. 12, the locking of the protrusion 332 in the second aperture 335 can reduce the length of the shank assembly and increase a structural strength of the shank assembly 3 in an open position of the umbrella.

Figure 13:
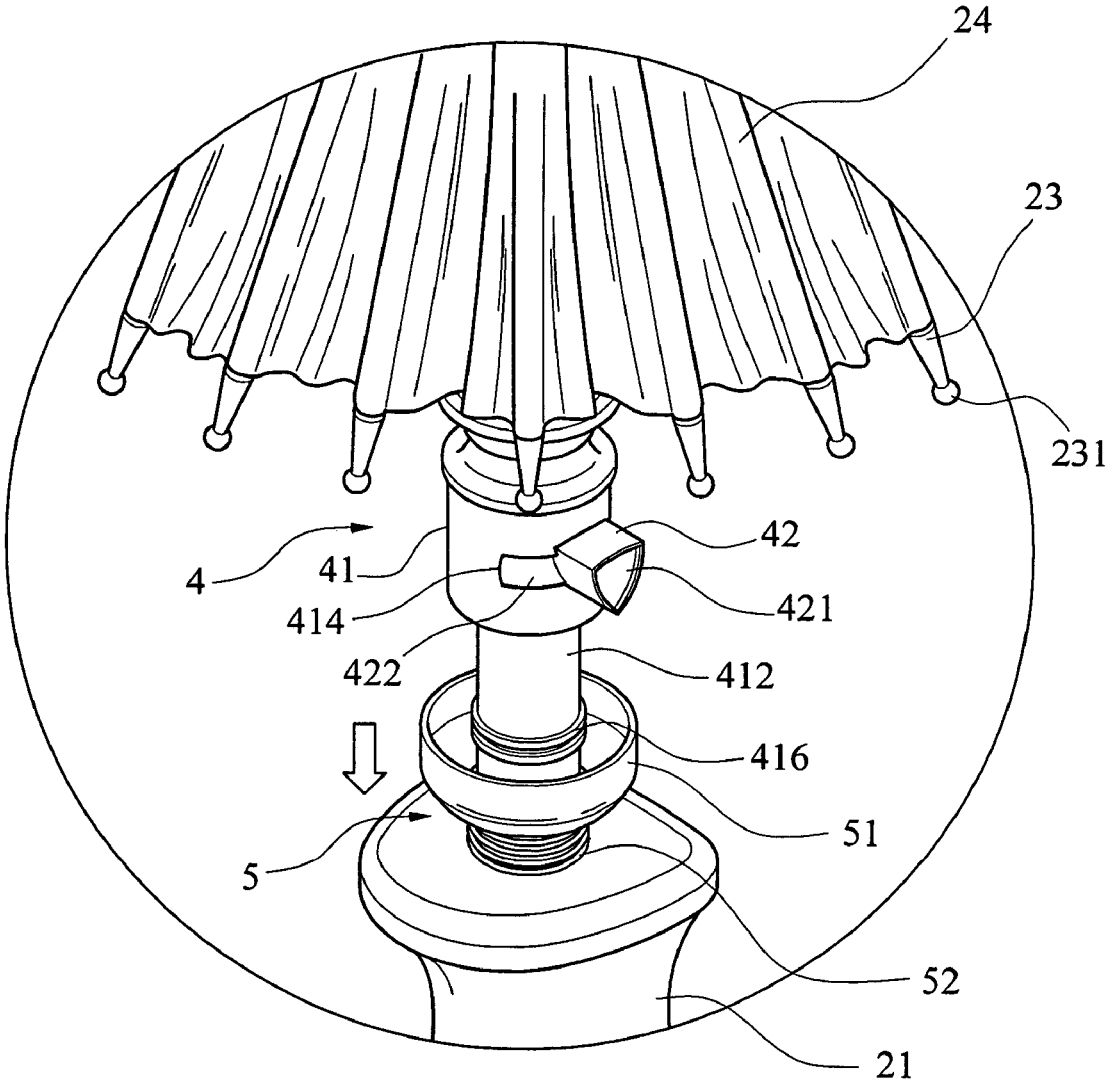
FIG. 13 is an enlarged view of the rib fixing assembly and adjacent components where rib tips are disengaging with the rib fixing assembly by pressing the cup.
Figure 14:
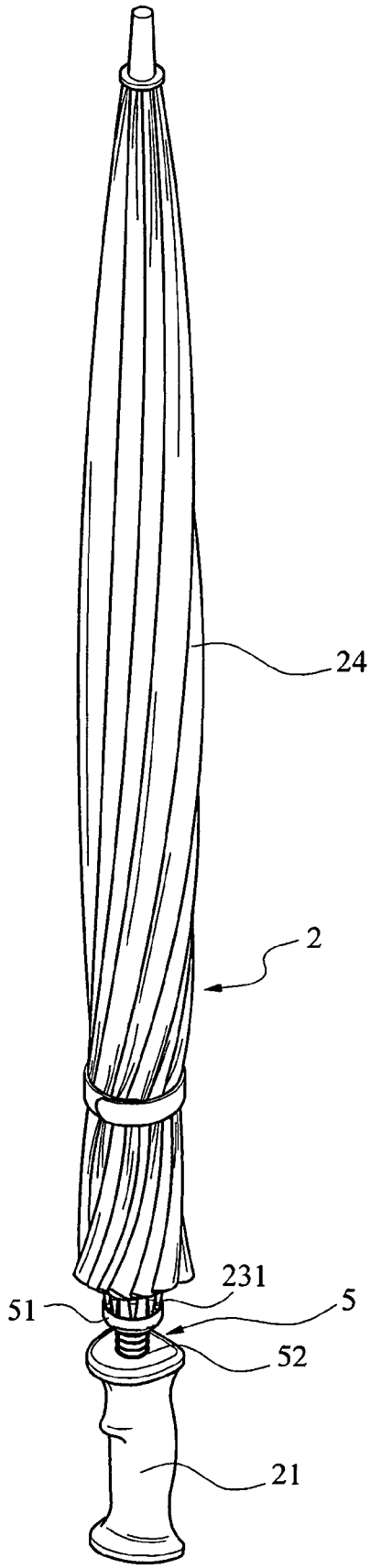
FIG. 14 is a perspective view of an umbrella incorporating either preferred embodiment of lock mechanism where canopy is tied and the rib tips are fixed by the rib fixing assembly in a closed position of the umbrella.

Referring to FIGS. 13 and 14, in a closed position of the umbrella rib tips 231 are adapted to dispose proximate the lower portion 412. Next, a user may manually put the rib tips 231 into the cup 51 for fastening. This can hold ribs 23 in place and reduce size of the closed umbrella to a minimum. A user may further tie a tie closure to tie canopy 24. For opening the umbrella, a user may simply press the cup 51 toward the handle 21 to compress the spring 52 until the rib tips 231 clear the cup 51. Next, a releasing of the pressing will expand the spring 52 upward to slide the cup 51 back to its inoperative position.

Figure 15:
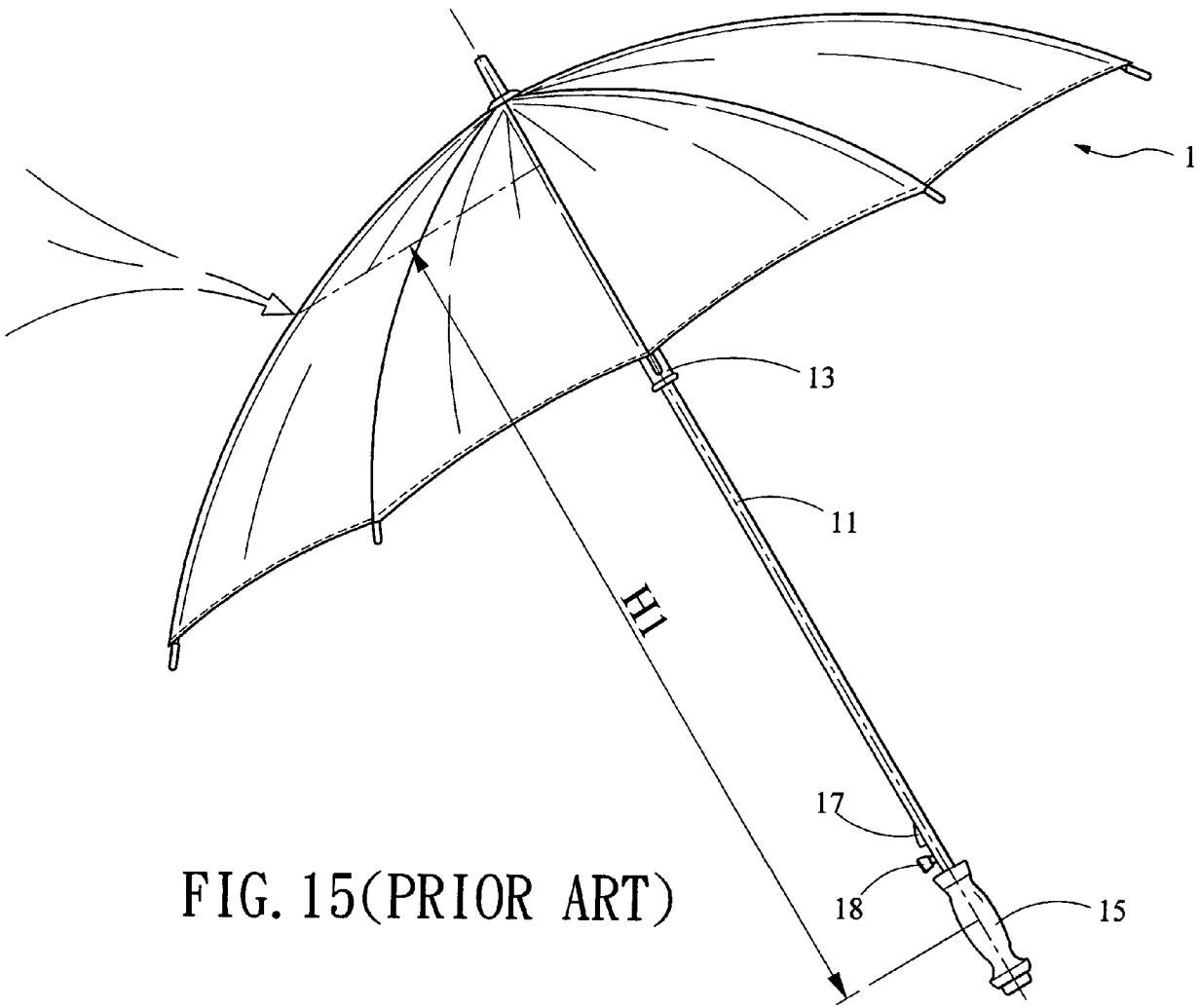
FIG. 15(PRIOR ART)
FIG. 15 is a perspective view of a prior umbrella in an open position for illustrating a distance between a virtual wind exertion plane on the canopy and the handle.
Figure 16:
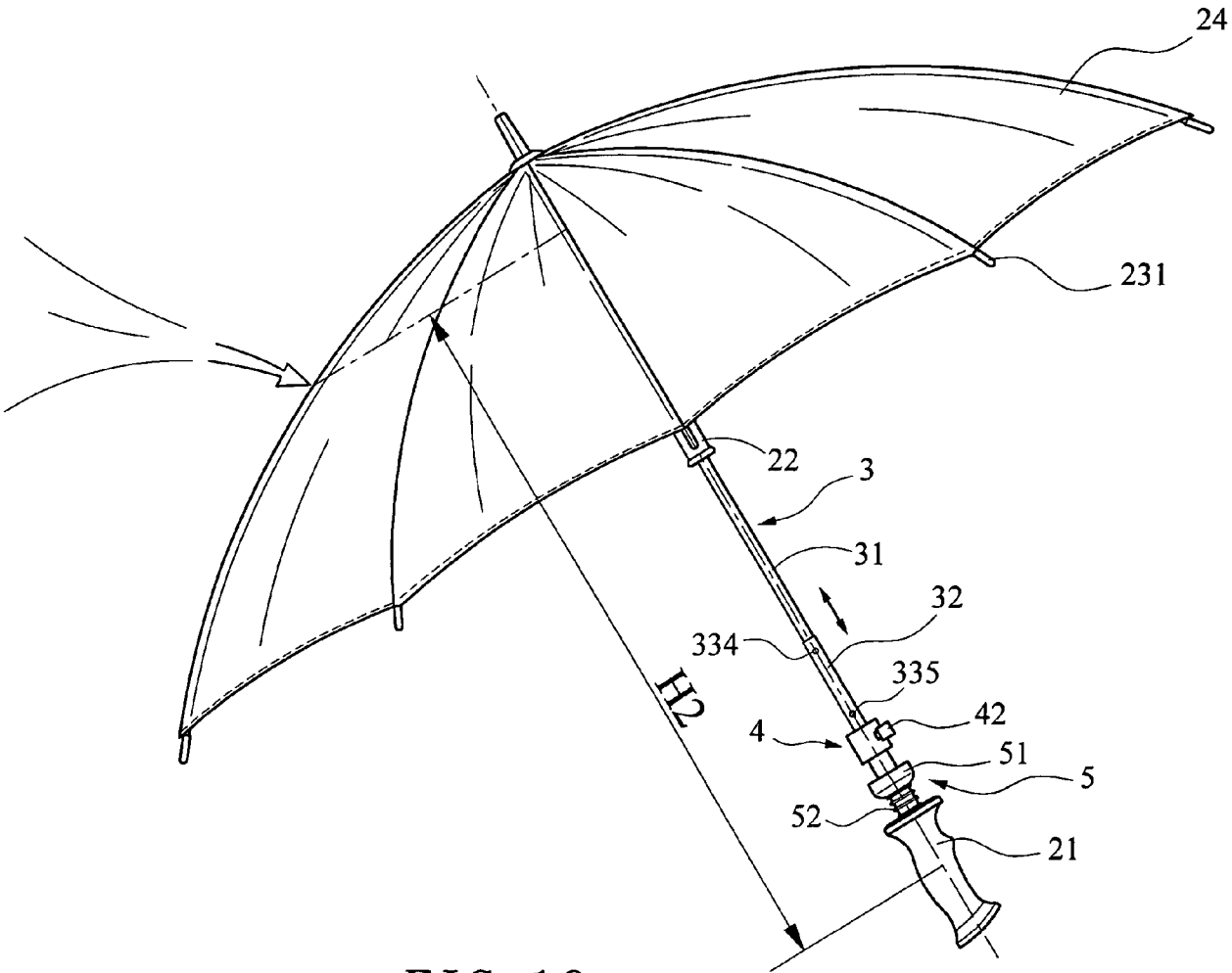
FIG. 16 is a perspective view of an umbrella of the invention in an open position for illustrating a distance between a virtual wind exertion plane on the canopy and the handle.

Referring to FIGS. 15 and 16, a user may quickly adjust a length of the shank assembly 3 (i.e., length of the upper tube 31) by operating the lock device 33 (i.e., the protrusion 332) in a manner the same as that described above in response to strong wind. It is seen that a distance H2 between a virtual wind exertion plane on the canopy 24 and the handle 21 of the umbrella 2 of the invention (see FIG. 16) is relatively smaller than a distance H1 between a virtual wind exertion plane on the canopy and the handle 15 of the umbrella 1 of the prior art (see FIG. 15). This means that pressure exerted upon the umbrella by strong wind is reduced significantly by the umbrella of the invention since a user may easily adjust length of the shank.

While the invention herein disclosed has been described by means of specific embodiments, numerous modifications and variations could be made thereto by those skilled in the art without departing from the scope and spirit of the invention set forth in the claims.

What is claimed is:

1. A lock mechanism mounted in a large umbrella having a handle, a plurality of ribs, a plurality of spreaders, and a canopy, the lock mechanism comprising:

a sliding sleeve connected to the spreaders and including a lower extension and a first aperture on a surface of the extension;

a telescopic shank including a lower tube fixed in the handle, a sliding upper tube adapted to slide in the lower tube, and a lock device disposed in the upper tube;

an actuation assembly including a hollow upper enlargement with the extension received therein, a transverse first opening formed on the enlargement, and a spring biased actuation member adapted to have a first predetermined portion disposed in the first aperture for locking the extension in a closed position of the umbrella, and a second predetermined portion disposed externally of the enlargement; and a spring biased rib fixing assembly disposed between the handle and the actuation assembly, the rib fixing assembly being adapted to fix tips of the ribs in the closed position of the umbrella;

whereby pushing the second predetermined portion of the actuation assembly will disengage the first predetermined portion with the first aperture to unlock the extension of the sliding sleeve for sliding the sleeve upward to open the umbrella, and operating the lock device of the telescope shank will effect a subsequent multi-sectional length adjustment of the shank.

2. The lock mechanism of claim 1, wherein the upper tube comprises a lengthwise groove and a lower second aperture, and wherein the lower tube comprises two longitudinal recesses in communication with each other and disposed in the groove so as to guide a sliding of the upper tube in the lower tube in a predetermined position.

3. The lock mechanism of claim 2, wherein the lower tube comprises a plurality of longitudinal holes formed on a surface thereof, and wherein the lock device comprises an arcuate elastic member urged against an inner surface of the upper tube, the elastic member including a protrusion formed at one end projected from the second aperture through one of the holes.

4. The lock mechanism of claim 3, wherein the protrusion is adapted to push to compress the elastic member until the protrusion clears the second aperture, the upper tube is adapted to subsequently push downward until the protrusion aligns with a different one of the holes, and wherein the protrusion is adapted to subsequently project from the different one of the holes.

5. The lock mechanism of claim 1, wherein the extension comprises two opposite projecting members formed above the first aperture, and wherein the enlargement further comprises two notches on its inner surface engaged with the projecting members.

6. The lock mechanism of claim 1, wherein the protrusion has a predetermined length for permitting the sleeve to pass therethrough by sliding in opening or closing the umbrella.

7. The lock mechanism of claim 1, wherein the enlargement further comprises a receptacle opposite the first opening for anchoring the actuation member, and a lower projecting portion including a plurality of flanges formed therearound; wherein the second predetermined portion of the actuation member is formed as a trigger; and wherein the actuation member further comprises a loop interconnected the first and the second predetermined portions, a cavity formed in the first predetermined portion opposite the receptacle, and a first elastic element having one end anchored in the receptacle and the other end anchored in the cavity.

8. The lock mechanism of claim 7, wherein the rib fixing assembly comprises a cup including a bottom second opening urged against one of the flanges, and a second elastic element compressed between the cup and the handle.

9. The lock mechanism of claim 8, wherein the tips of the ribs are adapted to dispose proximate the cup in response to closing the umbrella.

* * * * *